US005940890A

United States Patent [19]

Dallas et al.

[11] Patent Number: 5,940,890

[45] **Date of Patent: *Aug. 24, 1999**

[54] HELMET INCLUDING A STRAP SECURING DEVICE

[76] Inventors: Elizabeth Dallas, 30 Pearl St., Unit #1, Essex Junction, Vt. 05452; Roger M. Ball, 522 Pape Avenue, Toronto, Onterio, Canada, M4K3R4

[ * ] Notice: This patent issued on a continued prosecution application filed under 37 CFR 1.53(d), and is subject to the twenty year patent term provisions of 35 U.S.C. 154(a)(2).

[21] Appl. No.: 08/780,816

[22] Filed: Jan. 9, 1997

[51] Int. Cl.[6] ..... A42B 7/00

[52] U.S. Cl. ..... 2/421; 2/425

[58] Field of Search ..... 2/421, 424, 422, 2/425, 410, 452

[56] References Cited

U.S. PATENT DOCUMENTS

| | | | |
|---|---|---|---|
| 3,710,391 | 1/1973 | McGlynn . | |
| 3,797,040 | 3/1974 | Caldwell | 2/421 |
| 3,978,555 | 9/1976 | Weisenthal . | |
| 4,179,753 | 12/1979 | Aronberg et al. | 2/10 |
| 4,796,308 | 1/1989 | Bourgeois | 2/452 |
| 5,123,115 | 6/1992 | Braswell-Moore | 2/10 |
| 5,341,516 | 8/1994 | Keim | 2/424 |
| 5,517,698 | 5/1996 | Nault et al. | 2/425 |

FOREIGN PATENT DOCUMENTS

| | | |
|---|---|---|
| 0 052 067 A1 | 5/1982 | European Pat. Off. . |
| 0 553 037 A1 | 7/1993 | European Pat. Off. . |
| 2 619 989 A1 | 3/1989 | France . |
| 1 054 721 | 4/1959 | Germany . |
| 87 14 490 U | 11/1988 | Germany . |
| 1 405 623 | 9/1975 | United Kingdom . |
| WO 86/04791 A1 | 8/1986 | WIPO . |

OTHER PUBLICATIONS

International Search Report for PCT/US 97/23738, mailed on May 12, 1998, three pages.

*Primary Examiner*—Gloria M. Hale
*Attorney, Agent, or Firm*—Wolf, Greenfield & Sacks, P.C.

[57] ABSTRACT

A helmet including a strap securing device having a gripping section and/or a clip for engaging and holding a strap, for example a goggle strap, in place over the surface of the helmet is disclosed. The gripping section and clip may be utilized individually, or in combination, to engage and hold the strap. The gripping section preferably includes an outer surface which engages and secures the strap in place when utilized alone. The outer surface may be a textured surface and may include a plurality of raised nodules to enhance gripping. When utilized in combination with a clip, the strap may be sandwiched between the gripping section and the clip. The clip may, alternatively, be utilized alone to hold the strap in place. When utilized alone, the clip may be removably attached to the helmet to secure the strap between the clip and the outer shell of the helmet. Additionally, the clip may include a textured inner surface to enhance gripping, or may alternately include a textured outer surface for securing the strap over the outer surface of the clip when the clip is in a closed position.

23 Claims, 6 Drawing Sheets

HELMET INCLUDING A STRAP SECURING DEVICE

DESCRIPTION

1. Technical Field

The present application relates to a goggle securing device for use with a helmet.

2. Background of Related Art

Helmets and goggles or glasses are utilized in a variety of sports to provide head and eye protection to the wearer. Goggles generally include a strap which wraps around the head in order to secure and hold the goggles over the eyes of the wearer. When a helmet is used in combination with goggles, the goggle strap extends over the back of the helmet. In many sports, such as snowboarding and skiing, the goggle strap is attached to the rear of the helmet in order to help prevent the goggles from being lost if the goggle strap should slip off the helmet.

In conventional helmet designs, such as the snowboarding helmet shown in FIG. 1, a retention strap is formed into a loop and attached to the back of the helmet by a snap closure. The goggle strap is inserted through the loop and held in place by the loop until released by the user.

While conventional retention straps are usually effective in preventing the goggles from being lost if the goggle strap should slip off the helmet, they do not generally help in securing the goggle strap in place over the surface of the helmet. Therefore, a wearer may have to reposition his or her goggle strap several times in a day in order to keep the strap engaged about the surface of the helmet.

There is therefore a need for a helmet having a strap securing device which will aid in holding a strap in place over the surface of a helmet.

SUMMARY

In accordance with the present invention, there is provided a helmet including a strap securing device, the strap securing device including a gripping section and/or a clip for engaging and holding a strap in place over the surface of the helmet. The gripping section and/or clip may be utilized individually, or in combination, to engage and hold the strap, for example a goggle strap. The gripping section may be formed as part of the helmet, or may be made of a separate material attached to the helmet, and preferably includes an outer surface which engages and secures the strap in place. The gripping section may be utilized alone, or in combination with a clip, the strap preferably being sandwiched between the gripping section and the clip, when utilized in combination. Alternately, the clip may be utilized alone. When utilized alone, the clip may preferably be removably attached to the helmet and is constructed and arranged to secure the strap between the clip and the outer shell of the helmet.

In one embodiment, the outer surface of the gripping section is textured and may include a plurality of raised nodules.

In another embodiment, the gripping section may be disposed in a recess in the helmet.

In another embodiment, the clip may be disposed over a portion of the gripping section.

In another embodiment, the clip may include a textured inner surface to help secure the strap between the clip and the helmet or gripping section, or may alternately include a textured outer surface to secure the strap over the clip.

It is therefore an object of the invention to provide a helmet including a strap securing device which secures a strap over the surface of the helmet.

It is another object of the invention to provide a strap securing device including a gripping section and/or a clip, for use individually or in combination, to secure the strap over the surface of the helmet.

It is yet another object of the invention to provide a strap securing device having a textured surface to engage the strap.

BRIEF DESCRIPTION OF THE DRAWINGS

It should be understood that the drawings are provided for the purpose of illustration only and are not intended to define the limits of the invention. The foregoing and other objects and advantages of the various embodiments described herein will become apparent with reference to the following detailed description when taken in conjunction with the accompanying drawings in which.

DETAILED DESCRIPTION OF THE PREFERRED EMBODIMENTS

Figure 1:
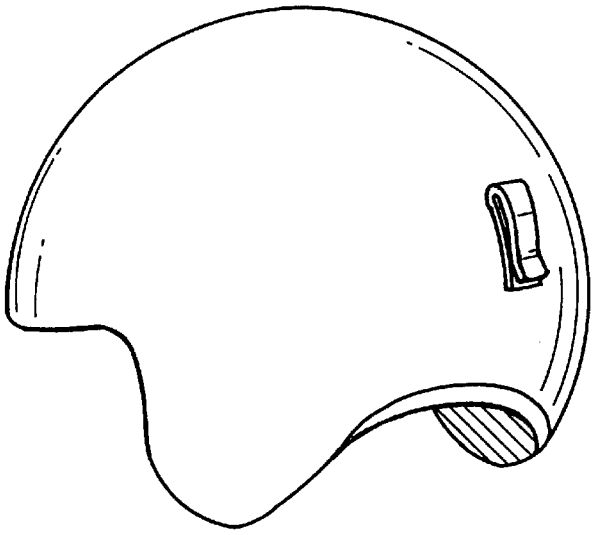
Fig. 1 (PRIOR ART)
FIG. 1 is a perspective view of a prior art goggle retention strap for use with a conventional helmet.
Figure 2:
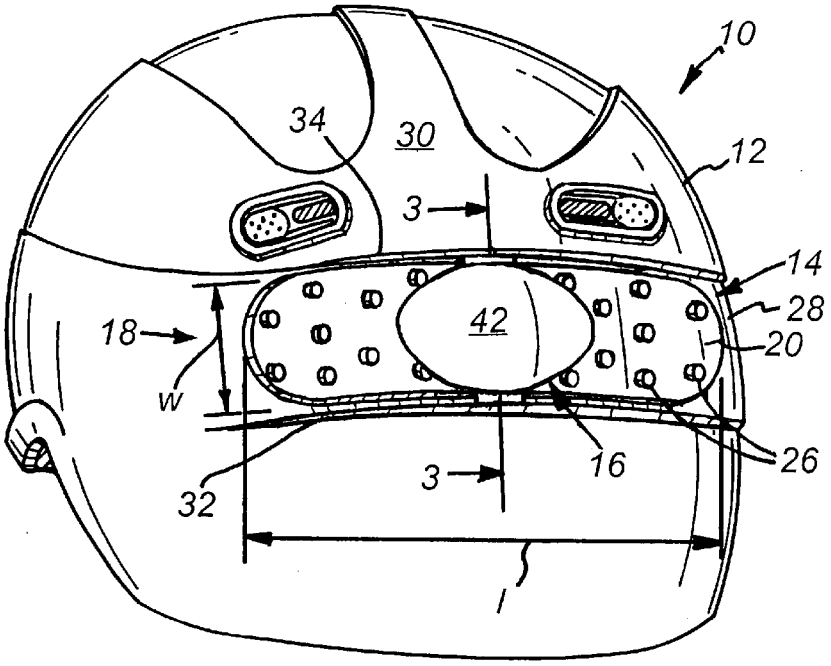
FIG. 2 is perspective view of a back portion of a helmet having a strap securing device including a gripping section and a clip, according to the present invention.

Referring initially to FIG. 2, there is illustrated a helmet 10 including an outer shell 12 and a strap securing device 14. In the present embodiment, strap securing device 14 may include a gripping section 18 disposed along the back of helmet 10 and a clip 16 inserted into the back of helmet 10.

Although clip 16 is shown in conjunction with gripping section 18, it should be understood that the clip and the gripping section may be utilized individually, as well as in combination. In addition, helmet 10 may be any style helmet utilized for any number of sports, with helmet 10 being preferably a hard shelled, impact resistant helmet, designed for use with goggles and, in the present embodiment, may be designed for winter use and may be utilized in the sport of snowboarding.

Figure 3:
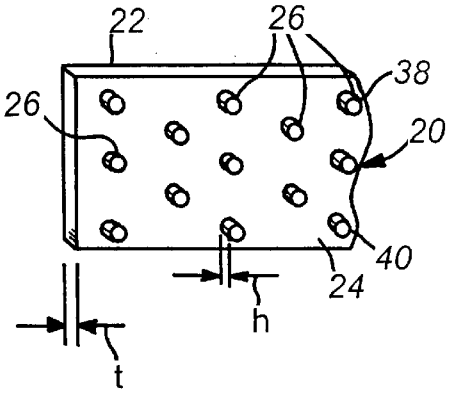
FIG. 3 is a detail view of one embodiment of the gripping section of FIG. 2.
Figure 4:
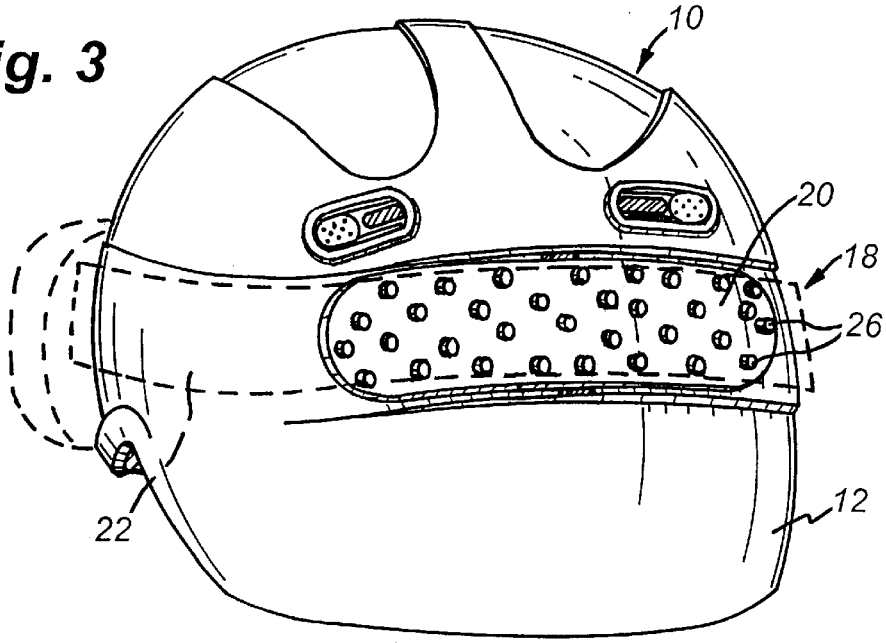
FIG. 4 is a perspective view of the helmet of FIG. 2, including a phantom strap secured over the gripping section of FIG. 3.

Referring now to FIG. 2 in conjunction with FIGS. 3 and 4, gripping section 18 may preferably be formed of a textured material 20 having an inner surface 22 which is supported by the outer shell 12 of helmet 10, and an outer, textured surface 24 for contacting and holding a goggle strap 22, or any other strap, in place over helmet 10. Alternately, gripping section 18 may be formed or molded as part of the helmet, and may or may not be made of different material than the helmet. In the present embodiment, textured material 20 may preferably be a clear, textured rubber, for example polyolefin, having a plurality of nodules 26 configured and arranged so as to form textured surface 24. Textured material 20 has a base thickness "t" of approximately 0.004 of an inch in the present embodiment, although other thickness may readily be utilized, is preferably pliable so as to conform to the contour of helmet 10, and may not crack or otherwise degrade in a cold weather environment. Alternately, gripping section 18 may be formed of any material, or combination of materials, which have a "gummy", "sticky" or "gripping" outer surface so as to engage and hold strap 22 in place. In addition, the material utilized may preferably be adapted for cold weather performance and may, therefore, not lose its ability to engage and hold goggle strap 22 in extreme temperatures or in extreme weather conditions, for example rain, sleet and snow. The textured material may also be integrated into the design of the helmet so as to compliment the overall shape and/or configuration of the helmet. As shown in FIG. 2, textured material 20 may be cut into a generally oblong, or elliptical shape before being adhered to helmet 10, the textured material being approximately 2 inches wide, "w", and approximately 8 inches long, "1", in the present embodiment, although other shapes and sizes will be readily known to one of skill in the art. After cutting textured material to its desired shape and size, the material is then adhered to helmet 10.

In the present embodiment, the inner surface 22 of textured material 20 is adhered to the outer shell 12 of helmet 10 by an adhesive, as will be known to those of skill in the art, the adhesive utilized preferably being permanent, adapted for cold weather performance and compatible with the material of outer shell 12 which it contacts. In the present embodiment, outer shell 12 may be a conventional helmet material, for example a thermoplastic material, therefore the adhesive utilized should be compatible with such thermoplastic materials and not degrade their mechanical properties.

Figure 5:
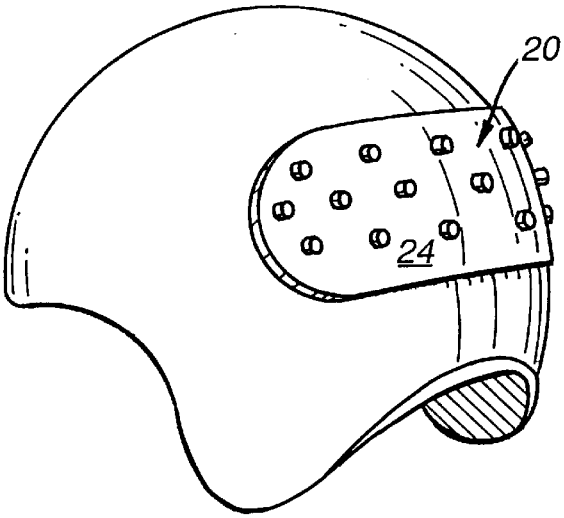
FIG. 5 is a perspective view of the helmet of FIG. 1, including a gripping section according to FIG. 2 of the present invention disposed along the back of the helmet.
Figure 6:
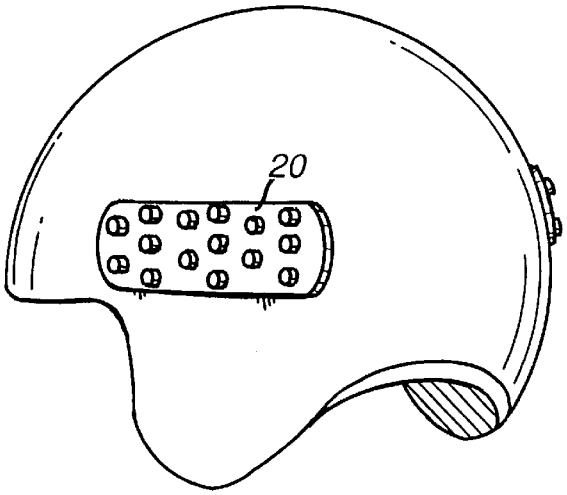
FIG. 6 is a perspective view of the helmet of FIG. 1, including a gripping section according to FIG. 2 of the present invention disposed along the sides of the helmet.

As illustrated in FIG. 2, helmet 10 preferably includes a stepped portion 28 for receiving textured material 20. Stepped portion 28 may be disposed along the back 30 of helmet 10 and preferably includes a lower ridge 32 and an upper lip 34, and is approximately 2 inches wide, as measured between the lower ridge and upper lip, in the present embodiment. Although an optional feature in the design of helmet 10, stepped portion 28 may help locate the position of textured material 20 during manufacturing and additionally, may help during placement and positioning of strap 22 by the user. Alternately, the helmet may include a recessed portion for receiving textured material 20, such that the base of the material is flush with outer shell 12 when recessed, or the textured material may be insert molded into helmet 10, or the material may simply be adhered to the outer surface of a conventional helmet, without a stepped portion or a recess, as shown in FIGS. 5 and 6. As shown in FIGS. 5 and 6, textured material 20 may alternately be placed over a relatively large surface area of helmet 10 and may additionally be placed in a variety of positions on the helmet, such as along either, or both, sides of the helmet in order to engage and secure strap 22.

Disposed opposite inner surface 22 is outer, textured surface 24 for engaging and gripping goggle strap 22. In the present embodiment, textured surface 24 preferably includes a plurality of raised nodules 26 disposed along surface 24. As shown in FIG. 3, nodules 26 may have a cylindrical shape, including a raised body portion 36 and a generally flat top portion 38, the nodules 26 being approximately 0.006 of an inch in height, "h", in the present embodiment. Although shown as a plurality of nodules in the present embodiment, any textured surface which would aid in the gripping and securing, or holding of strap 22 in place around helmet 10 may be utilized, as would be known to one of ordinary skill in the art. Such alternate textured surfaces may include, but are not limited to, alternate types of material, for example the hook shaped component of Velcro™ material, alternate shape nodules, for example frustoconical or square, and/or alternate size nodules. In the present embodiment, the generally flat shape of top portion 38 of nodules 26 is defined by an upper edge 40 which aids in the engagement and securing of strap 22 by gripping the strap, when the strap is in place over gripping section 18. Strap 22 may be any of a number of commercially available straps, may be utilized with any form of eyewear, and may be made of a fabric such as polyester. By gripping strap 22, as shown in FIG. 4, 30 textured surface 24 helps retain strap 22 in place on helmet 10. As shown in FIGS. 2 and 4, gripping section 18 may be used alone, or in combination with clip 16.

Figure 7:
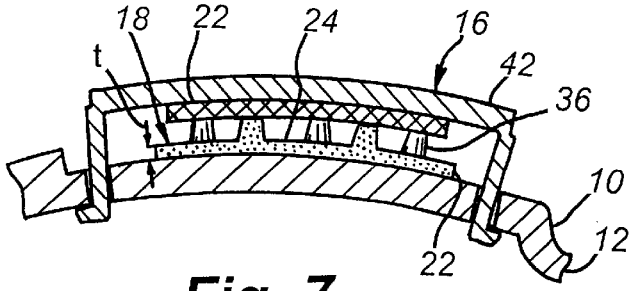
FIG. 7 is a cross-sectional view of the gripping section and clip of FIG. 2, engaging a strap.
Figure 8:
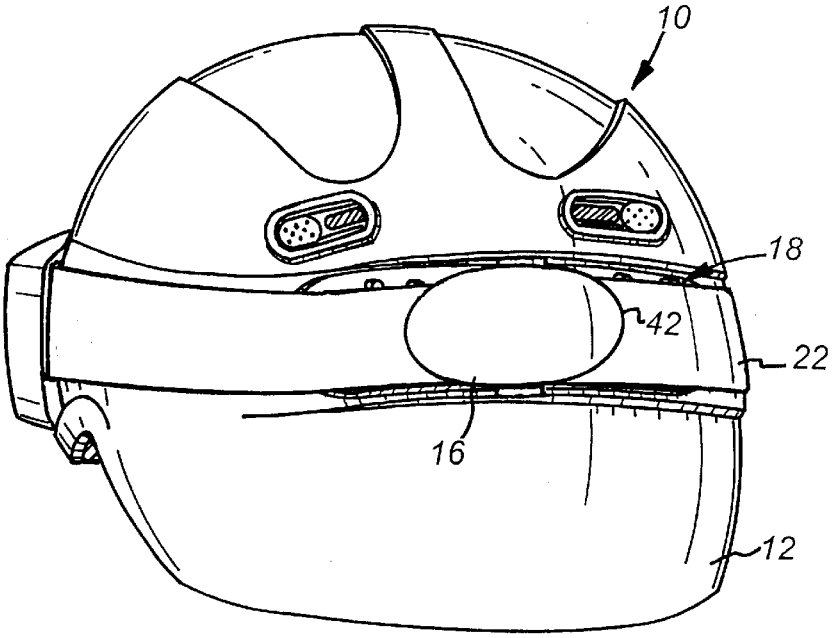
FIG. 8 is a perspective view of the helmet of FIG. 2 including a strap secured between the gripping section and clip.

Referring now to FIG. 2, in conjunction with FIGS. 7 and 8, there is illustrated clip 16 used in conjunction with gripping section 18. As described in greater detail hereinbelow, clip 16 may alternately be utilized without gripping section 18. When utilized with gripping section 18, clip 16 is disposed over section 18 such that goggle strap 22 is captured between gripping section 18 and the body 42 of clip 16 when the clip is in a closed, or engaged position. As shown in greater detail in FIG. 7, a bottom portion of goggle strap 22 engages nodules 26, while a top portion of strap 22 is engaged by a bottom portion of clip 16, thereby securing goggle strap 22 between the gripping section and the clip.

Figure 9:
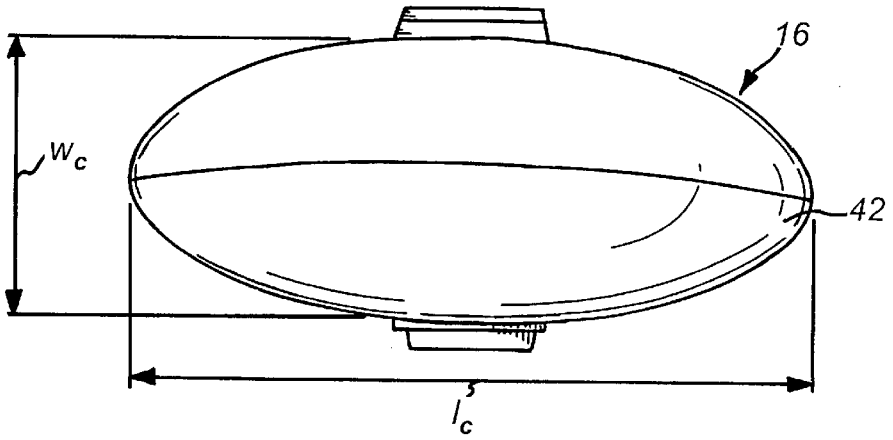
FIG. 9 is a top view of one embodiment of the clip of FIG. 2.
Figure 10:
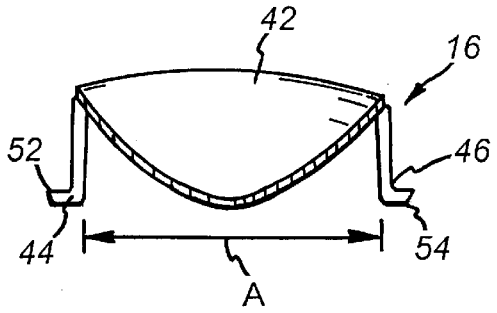
FIG. 10 is a side view of the clip of FIG. 9.

Referring now to FIGS. 9 and 10, clip 16 preferably includes a body portion 42, which may preferably be designed to match the contour of shell 12, the body 42 being generally elliptical and curved, in the present embodiment. Body 42 may be made of a flexible plastic, such as polyolefin, or alternately, may be made of any material designed for repetitive use, preferably in a cold weather environment. The length, "$1_c$", of clip body 42 is approximately 3.75 inches, while the width, "$w_c$", is approximately 1.5 inches, although alternate shapes and dimensions are contemplated, as would be apparent to one of skill in the art. In the present embodiment, clip 16 also includes a pair of legs 44 and 46, each leg having a first end extending from opposite sides of body portion 42. Legs 44 and 46 are designed to matingly engage a pair of corresponding apertures 48 and 50 (FIG. 11) formed in shell 12 of helmet 10. Legs 44 and 46 are preferably from approximately ¼ to ¾ inch in length, each leg being approximately ½ of an inch in length, in the present embodiment. Each leg 44 and 46 may preferably include an extension 52 and 54, respectively, extending from a second end thereof, each leg engaging the inner surface of shell 12 when legs 44 and 46 are inserted through apertures 48 and 50, as shown in FIG. 7, so as to hold clip 16 in place. Legs 44 and 46 may alternately be other sizes and configurations designed to hold clip 16 in place, as would be known to one of skill in the art.

Figure 11:
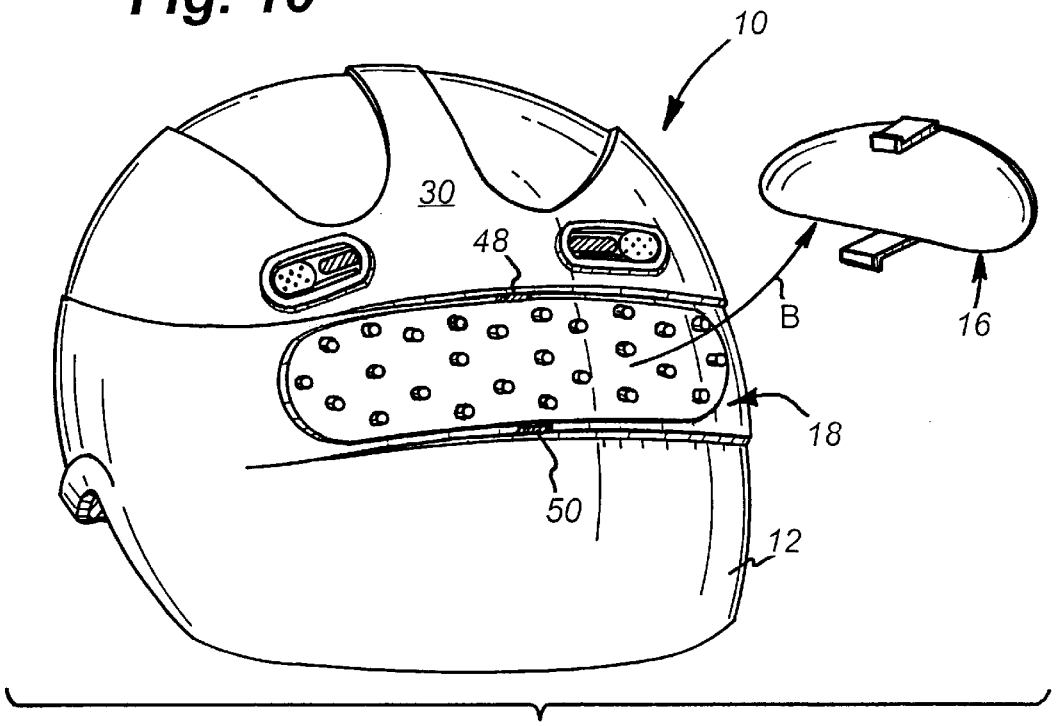
FIG. 11 is a perspective view of the helmet of FIG. 2 with the clip removed.

As shown in FIG. 11, apertures 48 and 50 are approximately centrally placed along the back 30 of helmet 10, are designed to releasably receive legs 44 and 46 of clip 16. In the present embodiment aperture 48 and 50 may preferably be rectangular in shape, disposed parallel to each other, and located approximately 2 inches apart so as to receive legs 44 and 46. As will be appreciated, the design and shape of apertures 48 and 50 is not intended to be limiting, and as such the apertures may be any number of shapes and sizes, provided that the apertures should be configured and dimensioned to receive legs 44 and 46 of clip 16. As shown in FIGS. 7 and 8, goggle strap 22 may be placed under body portion 42 and between legs 44 and 46 of clip 16, strap 22 preferably lying flat beneath body portion 42 when secured in place. When utilized with gripping section 18 the strap 22 is sandwiched between the gripping section and clip 16 as described above, when utilized alone, the strap 22 is secured between the clip 16 and the shell 12 of helmet 10.

Figure 12:
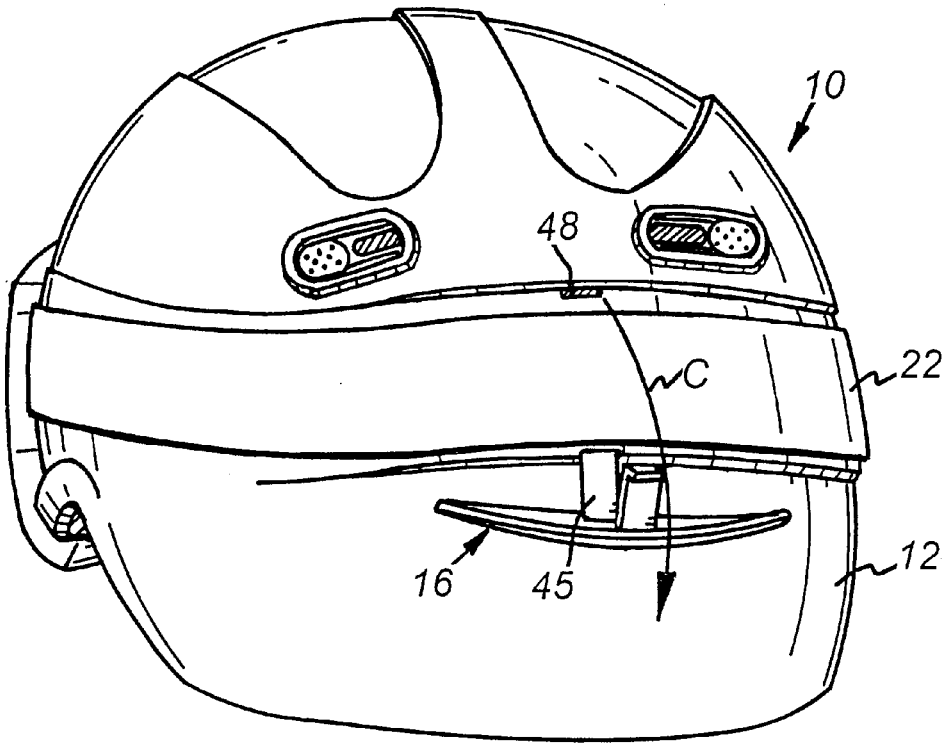
FIG. 12 is a perspective view of the clip of FIG. 9, being pivotally mounted within the helmet.

To release clip 16 from engagement with apertures 48 and 50, and hence strap 22, a user first grasps body portion 42 adjacent the first end of legs 44 and 46, and applies a slight pressure to the legs in order to move the legs in a first direction toward each other, as represented by arrow "A" (FIG. 10). As legs 44 and 46 move toward each other, extensions 52 and 54 are released from engagement with shell 12, and clip 16 may then be removed by pulling on the clip in the direction represented by arrow "B" (FIG. 11). Once released, legs 44 and 46 may resiliently move back into their original, unstressed configuration. Alternately, as illustrated in FIG. 12, one leg 45 may be designed with a larger extension (not shown) so that clip 16 may be pivoted, as represented by arrow "C", to release strap 22. In this manner the clip will remain attached to helmet 10 until such a time as the extension of leg 45 is released from engagement with shell 12, which may be done by applying pressure to leg 45 and moving the leg back and forth until the larger extension is released.

Figure 13:
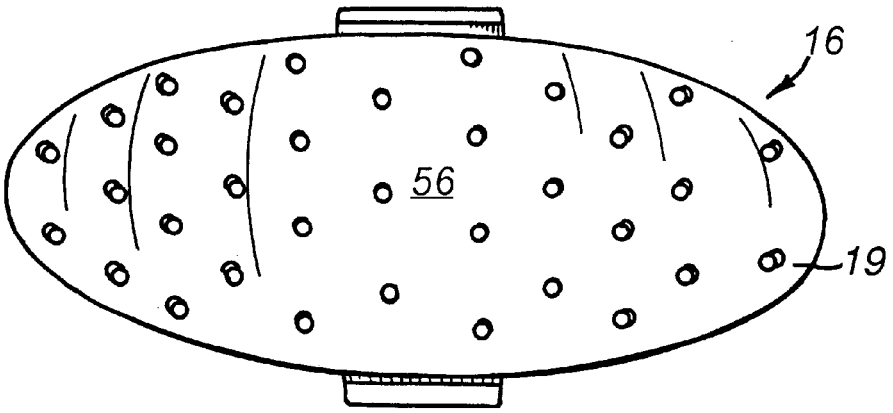
FIG. 13 is a bottom view a second embodiment of the clip of FIG. 2 having a textured, bottom surface.
Figure 14:
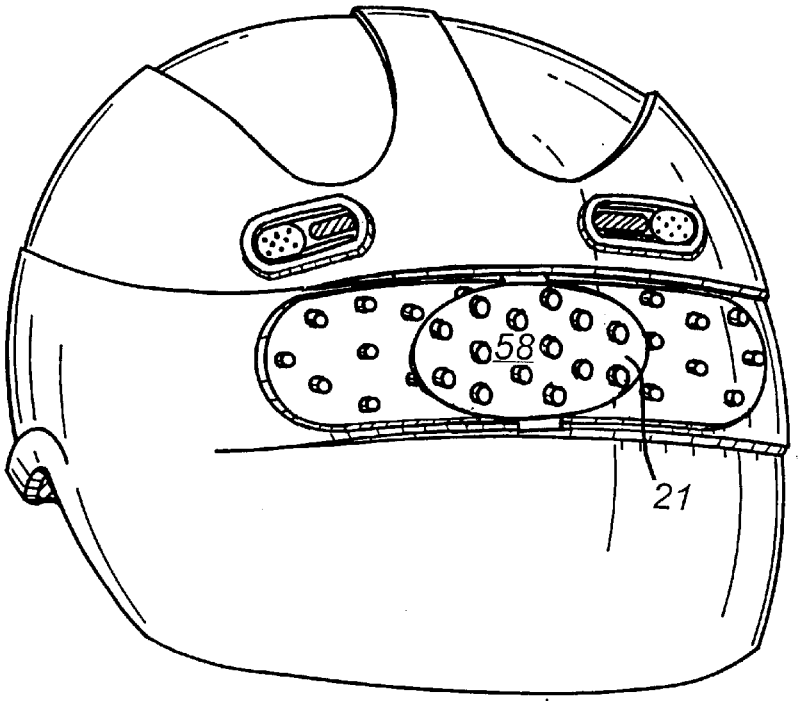
FIG. 14 is perspective view of the helmet of FIG. 2 including a third embodiment of the clip having a textured outer surface.
Figure 15:
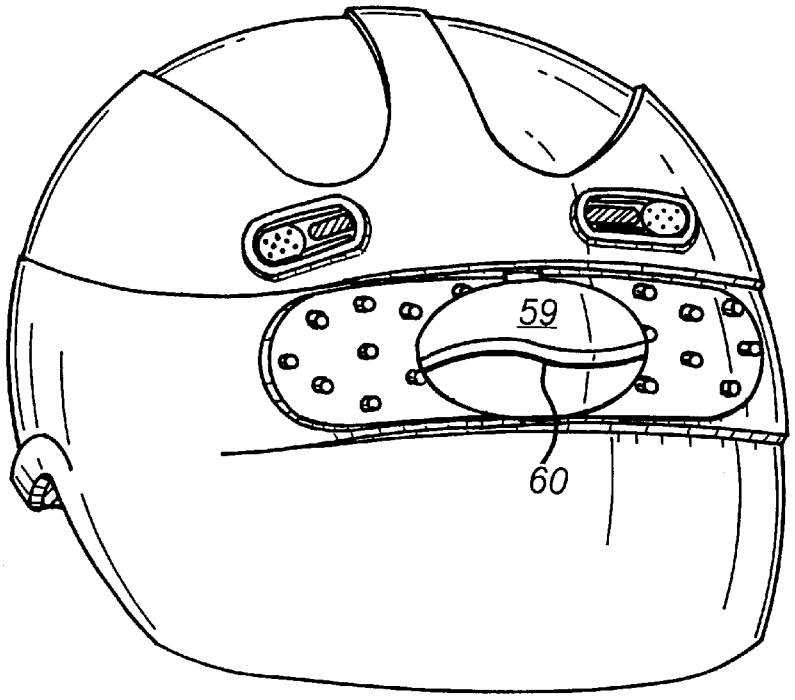
FIG. 15 is perspective view of the helmet of FIG. 2 including a fourth embodiment of the clip having an alternate textured outer surface.

Referring now to FIGS. 13–15, alternate embodiments of clip 16 having various textured surfaces, as described in greater detail below, are illustrated. Other than the addition of a textured surface, the embodiments of the clip illustrated in FIGS. 13–15 are the same as the previous embodiments. In the embodiment of FIG. 13, the bottom portion 19 of clip 16 which is designed to engage strap 22, includes a textured surface 56 designed to grip strap 22 when the strap is placed under clip 16. In the present embodiment, textured surface 56 may be made of the same material as textured surface 24, but may alternately be made of any material or have any texture which would aid in the gripping and securing, or holding of strap 22 in place under clip 16. In the embodiment of FIG. 14, top portion 21 of clip 16 includes a textured surface 58 designed to grip strap 22 when the strap is placed over clip 16. In this embodiment, a user may decide to place strap 22 either under clip 16 or may simply place the strap over clip 16 to hold the clip in place. In the present embodiment, textured surface 58 may be made of the same material as textured surface 24 and 54, but may alternately be made of any material or have any texture which would aid in the gripping and securing, or holding of strap 22 in place over clip 16, for example the texture shown in FIG. 15. The embodiment of FIG. 15, illustrates a clip 16 having a textured surface 59 including a contoured ridge 60 for engaging strap 22. Surface 59 may be made of rubber, or any alternate material capable of having a ridge formed thereon, and preferably being compatible with a cold weather environment. The alternate embodiments of clip 16 illustrated in FIGS. 13–15 may also be utilized with or without gripping portion 18 and may preferably operate in the same manner as a clip not having a textured surface.

It will be understood that various modifications may be made to the embodiment disclosed herein. For example, the dimensions of the clip and gripping section may be readily altered by one of skill in the art. Therefore, the above description should not be construed as limiting, but merely as exemplifications of preferred embodiments. Those skilled in the art will envision other modifications within the scope and spirit of the invention as claimed below.

What is claimed is:

1. A helmet including a strap securing device for retaining a strap over a surface of the helmet, the strap securing device comprising:

a gripping section supported by the helmet, the gripping section including an inner surface for engaging the helmet and a textured outer surface including a plurality of nodules, each nodule including a raised body portion extending from the outer surface and a top portion including an upper edge configured and arranged to engage and secure the strap over the surface of the helmet.

2. The helmet according to claim 1, wherein the gripping section is disposed along a back portion of the helmet.

3. The helmet according to claim 1, wherein the gripping section is disposed along at least one side of the helmet.

4. The helmet according to claim 1, further comprising a clip.

5. The helmet according to claim 4, wherein the strap is secured between the gripping section and the clip.

6. The helmet according to claim 4, wherein the clip is partially disposed over the gripping section.

7. The helmet according to claim 1, wherein the clip includes a body portion and a pair of legs extending from the body portion.

8. The helmet according to claim 7, wherein the legs extend through apertures disposed in the helmet.

9. The helmet according to claim 1, wherein the gripping section is formed of an elastomeric material.

10. The helmet according to claim 1, wherein the gripping section is disposed within a recess in the helmet.

11. The helmet according to claim 1, wherein the gripping section is disposed in a stepped portion of the helmet.

12. The helmet according to claim 1, wherein the top portion of each nodule is generally flat.

13. A helmet including a strap securing device for retaining a strap over a surface of the helmet, the helmet having a pair of spaced apertures, the strap securing device comprising:

a clip supportable by the helmet, the clip having a top and a bottom surface and including a pair of legs, the bottom surface of the clip being configured and arranged to engage and hold the strap over the surface of the helmet, each of the legs being configured and arranged for insertion into a corresponding one of the pair of spaced apertures disposed in helmet.

14. The helmet according to claim 13, wherein the clip is movable between an open and a closed position.

15. A helmet including a strap securing device for retaining a strap over a surface of the helmet, the strap securing device comprising:

a clip supportable by the helmet, the clip having a top and a bottom surface, the bottom surface of the clip being configured and arranged to engage and hold the strap over the surface of the helmet, and also having a pair of legs, each of the legs being configured and arranged for insertion into a corresponding aperture disposed in the helmet;

wherein the clip is movable between an open and a closed position; and wherein the top surface is textured for engagement of the strap when disposed over the clip when the clip is in the closed position.

16. A helmet including a strap securing device for retaining a strap over a surface of the helmet, the strap securing device comprising:

a clip supportable by the helmet, the clip having a top and a bottom surface, the bottom surface of the clip being configured and arranged to engage and hold the strap over the surface of the helmet, and also having a pair of legs, each of the legs being configured and arranged for insertion into a corresponding aperture disposed in the helmet;

wherein the clip is movable between an open and a closed position; and wherein the bottom surface is textured for engagement of the strap between the bottom surface of the clip and the surface of the helmet when the clip is in the closed position.

17. A helmet including a strap securing device for retaining a strap over a surface of the helmet, the strap securing device comprising:

a clip supportable by the helmet, the clip having a top and a bottom surface, the bottom surface of the clip being configured and arranged to engage and hold the strap over the surface of the helmet, and also having a pair of legs, each of the legs being configured and arranged for insertion into a corresponding aperture disposed in the helmet; and a gripping section supported by the helmet.

18. The helmet according to claim 17, wherein the strap is securable between the gripping section and the clip.

19. The helmet according to claim 13, wherein the apertures are disposed through the helmet.

20. A helmet including a strap securing device for retaining a strap over an outer surface of the helmet, the strap securing device comprising:

a clip removably attached to the helmet such that the clip is removable and reattachable to the helmet, the clip including a body portion with a top and bottom surface, the bottom surface being configured and arranged to engage and hold the strap in contact with the outer surface of the helmet, between the bottom surface of the clip and the outer surface of the helmet, the clip further including a pair of legs extending from the body portion in a direction transverse to the bottom surface, the pair of legs being configured and arranged to removably attach the clip to the helmet, the pair of legs being spaced apart to receive the strap therebetween.

21. A helmet including a strap securing device for retaining a strap over a surface of the helmet, the strap securing device comprising:

a gripping section supported by the helmet and formed of an elastomeric material, the gripping section including a textured surface to engage the strap, wherein engagement of the strap with the textured surface retains the strap over the surface of the helmet.

22. The helmet according to claim 20, wherein the legs are disposed adjacent opposing peripheral edges of the body portion.

23. The helmet according to claim 20, wherein the legs are substantially perpendicular to the bottom surface.

* * * * *